US010085559B2

(12) United States Patent
Schön et al.

(10) Patent No.: US 10,085,559 B2
(45) Date of Patent: Oct. 2, 2018

(54) FURNITURE PIECE COMPRISING ROLLER WHEEL ASSEMBLY

(71) Applicant: INTER IKEA SYSTEMS B.V., Delft (NL)

(72) Inventors: Daniel Schön, Kalvsvik (SE); Peder Eriksson, Hovmatorp (SE)

(73) Assignee: INTER IKEA SYSTEMS B.V., Delft (NL)

( * ) Notice: Subject to any disclaimer, the term of this patent is extended or adjusted under 35 U.S.C. 154(b) by 0 days.

(21) Appl. No.: 15/526,683

(22) PCT Filed: Nov. 12, 2015

(86) PCT No.: PCT/SE2015/051209

§ 371 (c)(1),
(2) Date: May 12, 2017

(87) PCT Pub. No.: WO2016/076787

PCT Pub. Date: May 19, 2016

(65) Prior Publication Data

US 2017/0318963 A1 Nov. 9, 2017

(30) Foreign Application Priority Data

Nov. 14, 2014 (SE) ..... 1451363

(51) Int. Cl.
*A47B 88/00* (2017.01)
*A47B 88/437* (2017.01)
*A47B 88/90* (2017.01)

(52) U.S. Cl.
CPC ..... *A47B 88/437* (2017.01); *A47B 88/941* (2017.01); *A47B 2210/0027* (2013.01);
(Continued)

(58) Field of Classification Search
CPC ... A47B 88/437; A47B 88/407; A47B 88/487; A47B 88/493; A47B 88/941; A47B 2210/0027; A47B 2210/0037
See application file for complete search history.

(56) References Cited

U.S. PATENT DOCUMENTS 3,836,223 A * 9/1974 Signore ..... A47B 88/433 312/334.14
3,926,491 A * 12/1975 Greer ..... A47B 88/941 29/417

(Continued)

FOREIGN PATENT DOCUMENTS

| | | | |
|---|---|---|---|
| CN | 202664826 | U | 1/2013 |
| GB | 2044077 | A | 10/1980 |
| KR | 20110043050 | A | 4/2011 |

OTHER PUBLICATIONS

International Search Report PCT/SE2015/051209, dated Mar. 3, 20016.

*Primary Examiner* — Daniel J Rohrhoff
(74) *Attorney, Agent, or Firm* — Merchant & Gould P.C.

(57) ABSTRACT

A moveable furniture piece, comprising at least one first panel and at least one second panel arranged perpendicular to one another, said first and second panels being separate parts and being connected to each other, said first panel being provided with a pre-mounted roller wheel assembly, comprising a wheel, positioned adjacent to a drawer side, such that the wheel traverses parallel with the side of the moveable furniture piece; wherein the second panel is provided with an opening dimensioned to receive the roller wheel assembly.

19 Claims, 8 Drawing Sheets

(52) U.S. Cl.
CPC ..... *A47B 2210/0037* (2013.01); *A47B 2210/0059* (2013.01); *A47B 2210/02* (2013.01)

(56) References Cited

U.S. PATENT DOCUMENTS

| | | | | | |
|---|---|---|---|---|---|
| 4,802,716 | A * | 2/1989 | Rock | A47B 88/941 | 312/263 |
| 4,872,735 | A * | 10/1989 | Rock | A47B 88/941 | 312/330.1 |
| 4,911,509 | A * | 3/1990 | Rock | A47B 88/941 | 312/348.1 |
| 6,443,545 | B1 * | 9/2002 | Woerner | A47B 88/9418 | 312/263 |
| 2007/0159039 | A1 * | 7/2007 | Lam | A47B 88/941 | 312/348.1 |
| 2010/0283365 | A1 * | 11/2010 | Chen | A47B 88/487 | 312/334.4 |
| 2013/0313954 | A1 * | 11/2013 | Koelling | A47B 88/14 | 312/319.1 |

* cited by examiner

FURNITURE PIECE COMPRISING ROLLER WHEEL ASSEMBLY

This application is a National Stage Application of PCT/SE2015/051209 filed 12 Nov. 2015, which claims benefit of Swedish Patent Application No. 1451363-4, filed 14 Nov. 2014, which applications are incorporated herein by reference. To the extent appropriate, a claim of priority is made to each of the above disclosed applications.

FIELD OF THE INVENTION

This invention relates to movable furniture pieces. More particularly this invention relates to drawers comprising improved roller wheel assemblies.

BACKGROUND OF THE INVENTION

Drawers such as those found in furniture are often sliding drawers comprising a system of wheels and tracks or runners. The wheels run within the track and allow the drawer to slide. Generally the wheels are attached to the side panels of the drawer.

Thin walled drawers manufactured from materials such as sheet metal are well known on the market. To reduce cost of production and environmental impact it is ideal to reduce the thickness of the side panels or walls of the drawer. A problem with reducing the thickness of the panels is that the panels are prone to failure at the point where the wheels are attached on the side panels.

Drawers also comprise multiple panels which are fixed together. Traditionally drawers comprise two side panels, a bottom panel, a front panel and a rear panel. The assembly of the drawer can be complex and comprise riveting or other similar permanent means. Drawers comprising several panels which can be assembled by clipping together a kit of parts have been described in UK2044077. However, the complex shapes are only suitable for plastic walled drawers and not suitable for thin walled metal drawers.

U.S. Pat. No. 4,872,735 describes a drawer comprising roller wheels attached to a flange extending from the side wall of the drawer. This complex shaped part is not ideal as it is expensive to manufacture in comparison to the side panels of the drawer.

A furniture piece comprising an improved roller wheel assembly is desirable.

SUMMARY OF INVENTION

Accordingly, the present invention preferably seeks to mitigate, alleviate or eliminate one or more of the above-identified deficiencies in the art and disadvantages singly or in any combination and solves at least the above mentioned problems by providing a moveable furniture piece, comprising at least one first panel and at least one second panel arranged perpendicular to one another, said first panel and said second panel being separate parts and being connected to each other, said first panel being provided with a pre-mounted roller wheel assembly, comprising a wheel, positioned adjacent to a drawer side, such that the wheel traverses parallel with the drawer side; wherein the second panel is provided with an opening dimensioned to receive the roller wheel assembly.

An advantage is that the movable furniture piece has improved possibility to withstand forces to which the wheel may be exposed during operation.

According to one embodiment the first panel forms the rear panel of the moveable furniture piece. An advantage of this embodiment is that the forces to which the wheel is exposed are efficiently absorbed when the roller wheel assembly is pre-mounted to the rear panel.

According to one embodiment the roller wheel assembly comprises an axle which extends parallel to and along the rear panel and perpendicular to the side of the moveable furniture piece; and wherein the roller wheel assembly is attached to the rear panel via the axle. An advantage of this embodiment is that forces to which the wheel is exposed will be absorbed in the rear panel, thereby reducing the bending forces on the sides of the moveable furniture piece. According to one embodiment the rear panel is provided with at least two wheel assemblies arranged in opposite lateral ends of the rear panel. An advantage of this embodiment is that both roller wheel assemblies that are often needed in a movable furniture piece are arranged on one and the same panel, the rear panel, making manufacturing more efficient. Furthermore, forces acting on one wheel may be transferred, via the rear panel, to the other wheel, such that the two wheel assemblies may support each other.

According to one embodiment a web portion of the rear panel forms a receptacle for an axle connected to the wheel of the roller wheel assembly. An advantage of this embodiment is that a roller wheel assembly can be efficiently mounted to the rear panel. Preferably said web portion is a top edge of the rear panel. This provides for efficient mounting of a wheel assembly in a position which is often preferred in moveable furniture pieces, such as drawers.

According to one embodiment the first panel forms the side of the moveable furniture piece. This embodiment may be advantageous in some cases where there is no space for mounting the roller wheel assembly to the rear panel.

According to one embodiment the roller wheel assembly comprises an axle and a wheel hub wherein the roller wheel assembly is attached via the wheel hub to the first panel. This embodiment may be advantageous in some cases where there is limited space for, for example, a receptacle housing an axle.

According to one embodiment, the roller wheel assembly is adapted for supporting a connection of the first panel to the second panel. An advantage of this embodiment is that the roller wheel assembly may co-operate with the second panel, to support an efficient connection of the first and second panels.

According to one embodiment the roller wheel assembly comprises a double flanged washer arranged on the axle and co-operating with the second panel. An advantage of this embodiment is that connection between first and second panels becomes particularly efficient.

According to one embodiment the first panel is made from sheet metal. An advantage of this embodiment is that a strong fixing of the roller wheel assembly is provided. Furthermore, the sheet metal results in efficient utilization of space, such that the moveable furniture piece, e.g., a drawer, will obtain a larger internal space. Preferably, also the second panel is made from sheet metal. This provides for even more efficient utilization of the moveable furniture piece.

According to a preferred embodiment, the moveable furniture piece is a thin walled drawer comprising panels formed of sheet metal. This drawer is strong, and yet has a low weight and a large internal space.

According to one embodiment the material thickness of the sheet metal is 0.5-1 mm. This material thickness provides for a thin walled drawer that still has good mechanical strength.

According to a further aspect, there is provided a piece of furniture which comprises a moveable furniture piece, as described hereinabove, and a furniture carcass. This piece of furniture, which for example may be a cupboard or a kitchen cabinet, is strong and requires limited space in shipping, as the movable piece of furniture, such as a drawer, can be mounted at the location of the end customer, involving mounting the first panel to the second panel, and then attaching the movable piece of furniture to the carcass.

Further preferred embodiments will be apparent from the below description and the appended claims.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DESCRIPTION OF EMBODIMENTS

The following description of the present invention describes a furniture piece and a moveable furniture piece such as a furniture drawer with improved force handling and durability. A furniture piece can comprise the moveable furniture piece described herein and a carcass within which the moveable furniture piece is moveable.

Figure 1:
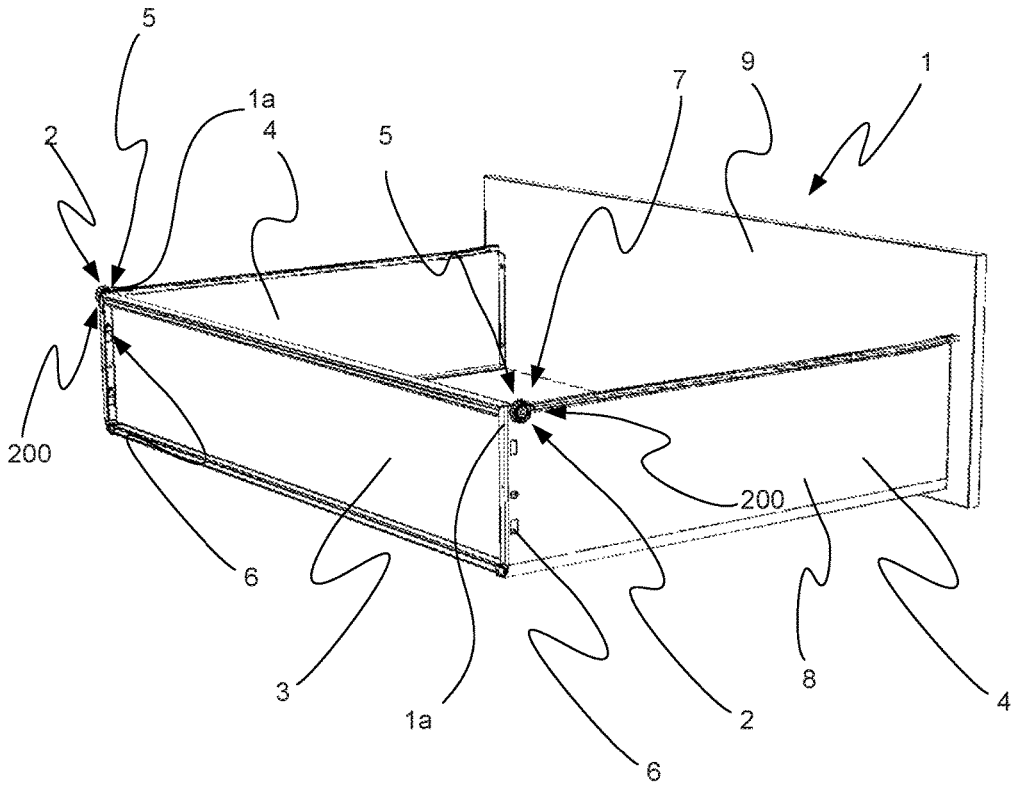
FIG. 1 is an isometric view of a drawer according to a first embodiment of the invention.

As shown in FIG. 1 the moveable furniture piece is, according to a first embodiment, a drawer 1 which comprises a first panel 3 and a second panel 4 arranged perpendicular to one another. As will be described further below, the first and second panels 3, 4 are separate parts being connected to each other during assembly of the drawer 1. The first panel 3 is provided with a roller wheel assembly 2. The roller wheel assembly 2 is positioned adjacent to the drawer side 8 such that a wheel 200 of the wheel assembly 2 traverses parallel with the drawer side 8. The second panel 4 is provided with an opening 5, best shown in FIG. 2*a*, dimensioned to receive the roller wheel assembly 2.

An advantage of having the opening 5 of the second panel 4 dimensioned to receive the roller wheel assembly 2 is that the forces acting on the roller wheel assembly 2 during operation of the drawer 1 can be transferred to both the first 3 and second 4 panels.

The first panel 3 and the second panel 4 can be substantially rectangular panels forming the walls of the drawer 1. As can be seen in FIG. 1 the first panel 3 and the second panel 4 can be arranged perpendicular to each other such that the panels form a right angled corner of the drawer 1. The first panel 3 can be a panel forming the rear panel 3 of the drawer 1, the rear panel 3 being arranged opposite to a front panel 9 of the drawer 1. The front panel 9 is that panel 9 which during normal use of the drawer 1 faces the user. The second panel 4 can be a panel forming the drawer side 8. As illustrated in FIG. 1, two parallel second panels 4 may be connected to opposite ends of the first panel 3.

Figure 2A:
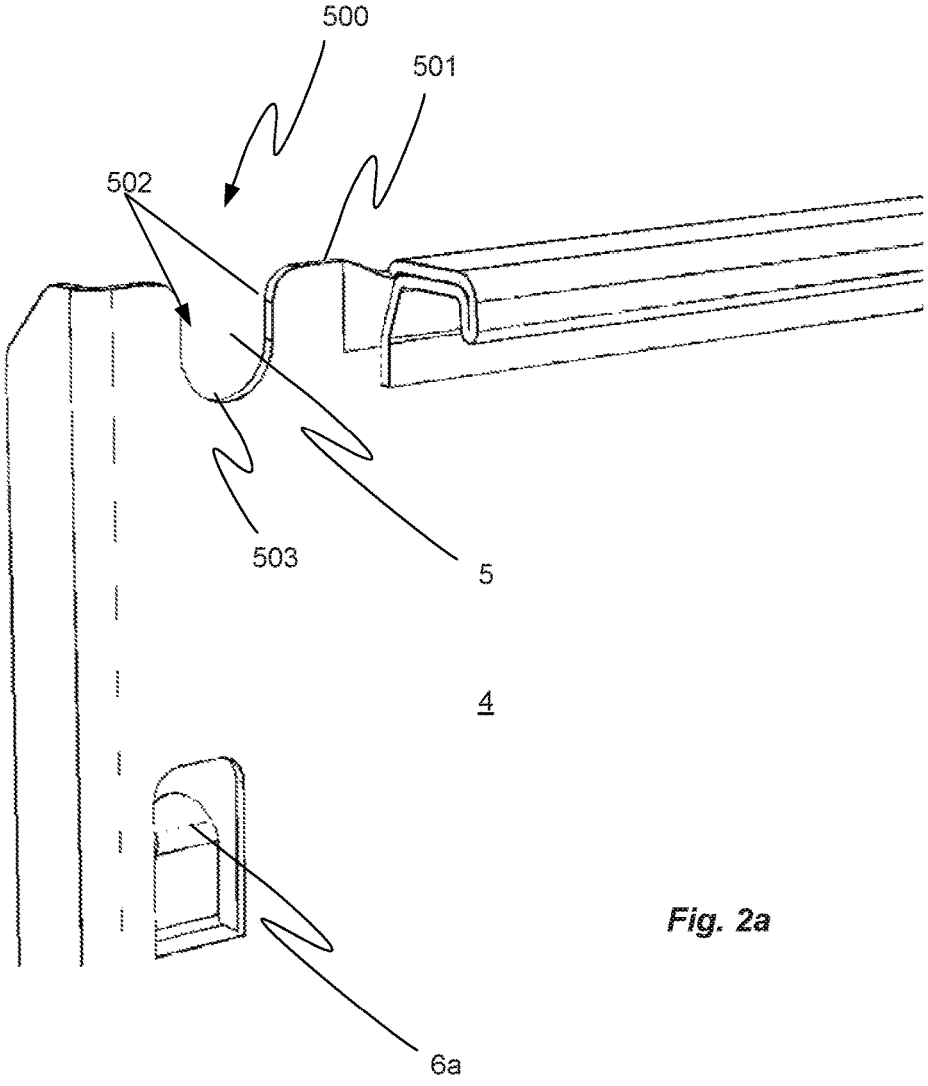
FIG. 2*a* is an isometric view of a portion of a second panel comprising a first embodiment of a slot.

To form a drawer corner the first panel 3 and the second panel 4 can be fixed to one another. The first panel 3 can be connected releasably to the second panel 4 by, for example, a clip system 6. The clip system 6 comprises hook parts 6*a* on the second panel 4, as best shown in FIG. 2*a*, and receiving parts on the first panel 3 to which the hook parts 6*a* are connected. The clip system 6 enables the panels 3, 4 to be connected to each other without the use of permanent fixtures, such as rivets or welding. The first panel 3 can also be connected to the second panel 4 via other means such as screws or bolts. As stated previously, drawers also generally comprise a bottom panel 7. The bottom panel 7 can be attached to the first panel 3 and/or to the second panel 4.

As shown in FIG. 1 the wheel assembly 2 comprises the wheel 200 positioned adjacent to the drawer side 8 and having a direction of traversal which is parallel with the drawer side 8 of the drawer 1. The drawer 1 in FIG. 1 has two roller wheel assemblies 2 arranged at opposite sides of the drawer 1. The roller wheel assemblies 2 are positioned at the respective upper rear corners 1*a* of the drawer 1.

As shown in FIG. 2*a* the opening 5 can be a slot 500 shaped as a U shaped slot extending from an upper edge 501 of the second panel 4. The U shaped slot 500 is an opening 5 which extends perpendicular to the upper edge 501 of the second panel 4. In such an embodiment the U shaped slot 500 comprises a slot with two substantially parallel edges 502 joined by a rounded bottom 503. The two parallel edges 502 of the slot 500 extend from the edge 501 of the second panel 4 and the rounded bottom 503 is distal to the edge 501 of the second panel 4. The U shaped slot forms the opening 5 which is designed to receive the wheel assembly 2.

Figure 2B:
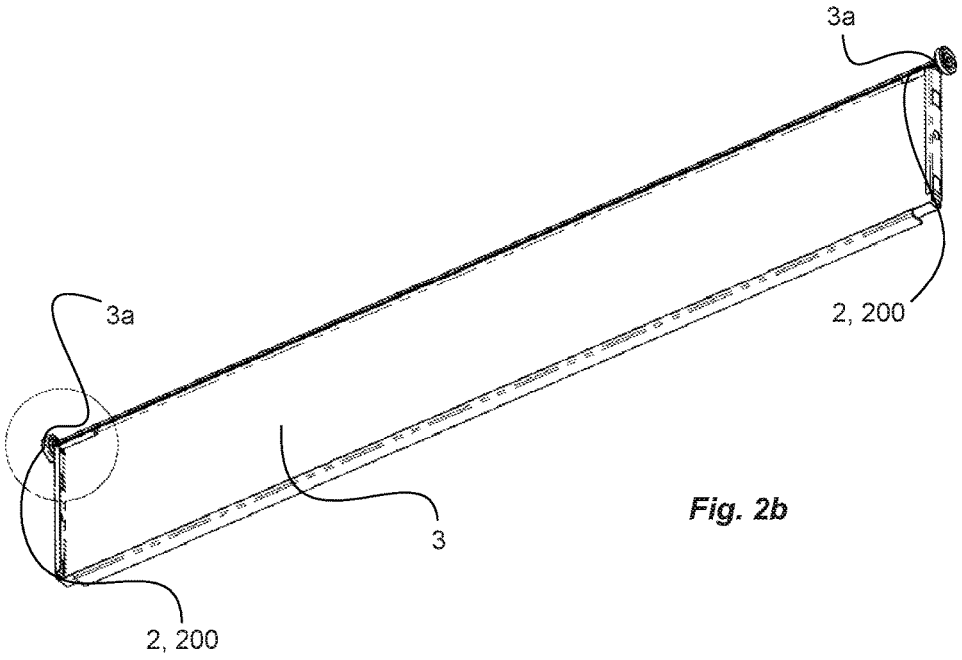
FIG. 2*b* is an isometric view of a first panel according to an embodiment.
Figure 2C:
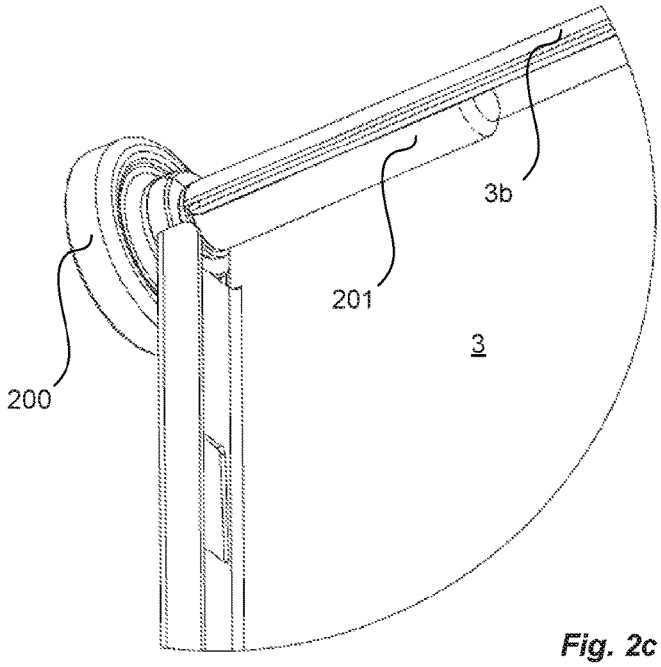
FIG. 2*c* is an isometric view of an enlarged section of the first panel shown in FIG. 2*b;*

Now turning to FIGS. 2*b* and 2*c* the first panel 3, i.e. the rear panel 3 of the drawer 1 shown in FIG. 1, is shown in more detail. As shown in FIG. 2*b* the rear panel 3 is provided with two roller wheel assemblies, each comprising a wheel 200, the roller wheel assemblies being arranged in opposite lateral ends of the rear panel 3. Each upper lateral corner 3*a* of the panel 3 is provided with a respective pre-mounted roller wheel assembly 2 comprising the roller wheel 200. More particularly, the entire roller wheel assembly 2 is pre-mounted to the first panel 3, at the respective upper lateral corner. As the roller wheel assembly 2 is supported by the rear panel 3 a significantly more robust construction is provided as the forces, acting on the wheel 200 during operation of the drawer 1, will not only act on the side walls 4. On the contrary, a substantial portion of the forces acting on the wheel 200 will be directed along the rear panel 3, and will be supported by the inherent stiffness of the rear panel 3.

For example, a web portion 3*b* of the rear panel 3 may be folded around the axle 201 to fix the roller wheel assembly 2 to the rear panel 3, as is best illustrated in FIG. 2*c*.

Figure 3A:
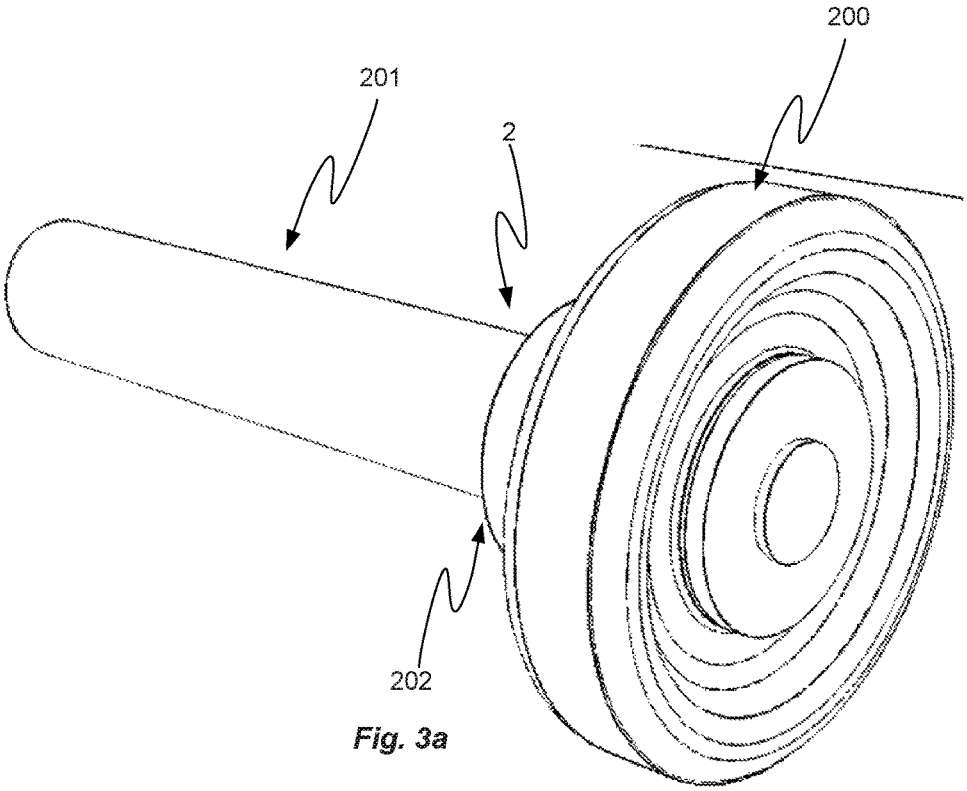
FIG. 3*a* is an isometric view of a roller wheel assembly according to an embodiment.

As can be seen in FIG. 3*a* the roller wheel assembly 2 comprises a wheel 200, axle 201 and hub 202. The roller wheel assembly 2 can be attached permanently to the first panel 3 via the axle 201 or the hub 202 (see FIG. 2*c*). To reduce the number of components of the roller wheel assembly 2 the axle 201 and the hub 202 can be monolithic. When the hub 202 and the axle 201 are monolithic the hub 202 is formed by a flanged member on the axle 201 proximal to the wheel 200. The roller wheel assembly 2 can be fixed to the first panel 3 via e.g. welding, riveting, clamping or similar processes.

Figure 3B:
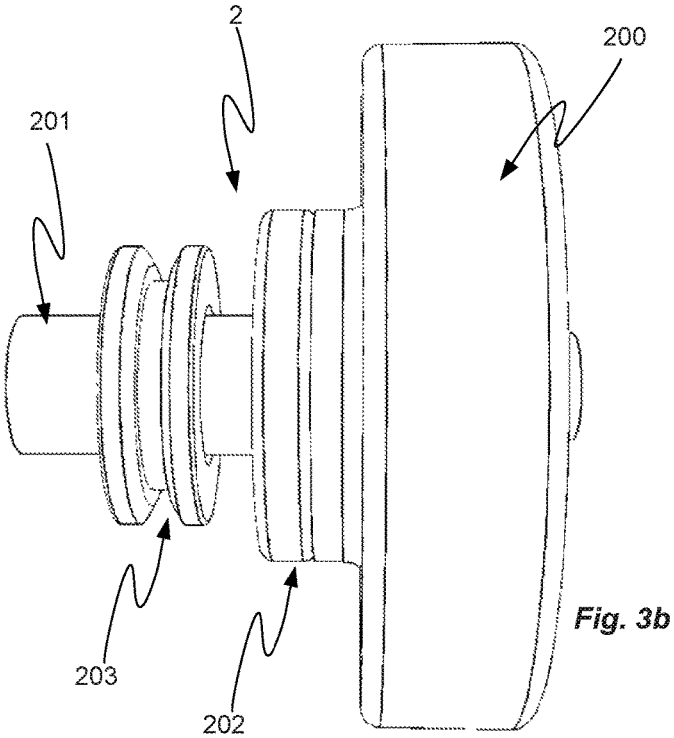
FIG. 3*b* is an isometric view of a roller wheel assembly comprising a double flanged washer.
Figure 3C:
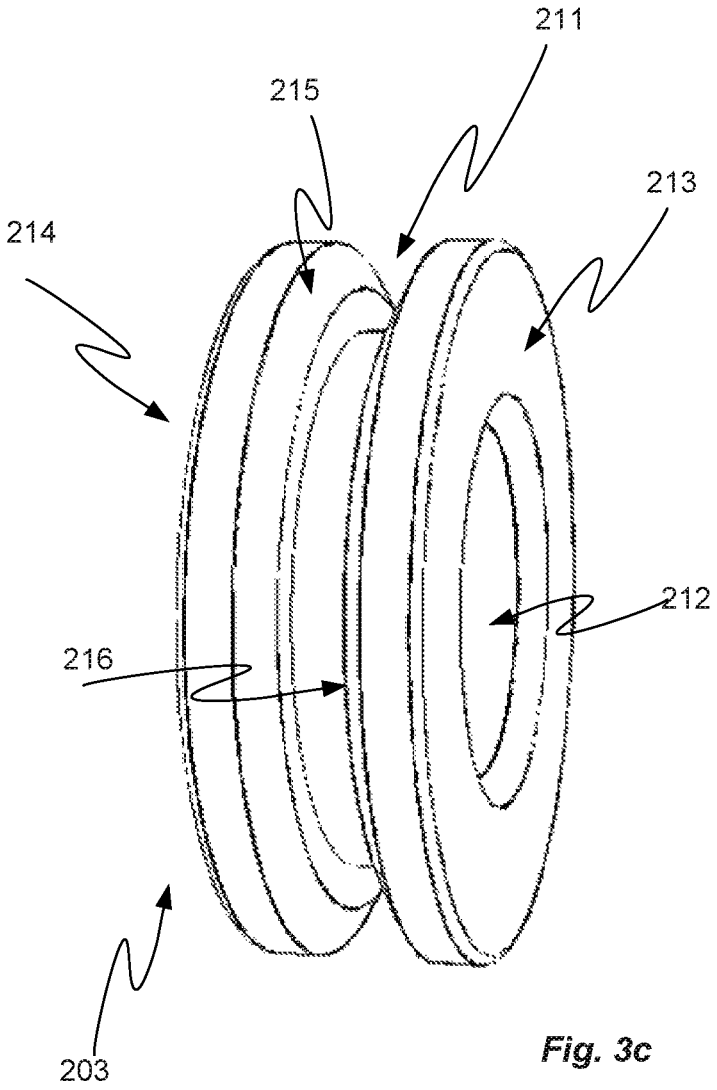
FIG. 3*c* is an isometric view of the double flanged washer shown in FIG. 3*b;*

As shown in FIG. 3*b* the wheel assembly 2 can further comprise a double flanged washer 203. A closer and isolated view of the washer 203 can be seen in FIG. 3*c*. The washer 203 comprises a disc having a first face 213, a second face 214 and a central bore 212. The double flanged washer 203 further comprises a circumferential channel 211. The circumferential channel 211 can be located approximately an equivalent distance from the first 213 and second 214 faces. The circumferential channel 211 forms a first internal face 215 and a second internal face 216. The washer 203 is especially useful if the wheel assembly 2 is to have the additional function of securing the second panel 4 of the drawer 1 to the first panel 3.

The circumferential channel 211 can be dimensioned such that it has a width that is approximately equivalent or slightly greater than the material thickness of the second panel 4 of a drawer. The circumferential channel 211, having a width of equivalent to or slightly greater than the material thickness of the second panel 4 of the drawer 1, can act to hold the second panel 4 in place between the first and second internal faces 215, 216. The central bore 212 is dimensioned such that the axle 201 of the wheel assembly 2 fits through the central bore 212.

The first panel 3 can be the rear panel 3 of the drawer 1, as illustrated in the embodiment of FIG. 1. If the first panel 3 is the rear panel of the drawer 1 the wheel assembly 2 is attached to the first panel 3 via the axle 201. The axle 201 extends parallel to and along the rear panel 3 and perpendicular to the drawer side. The axle 201 being attached parallel to and along the rear panel 3 results in a force on the wheel 200 acting in a direction parallel to the axis of the axle 201 being distributed along the length of the interface between the axle 201 and the rear panel 3.

Figure 4:
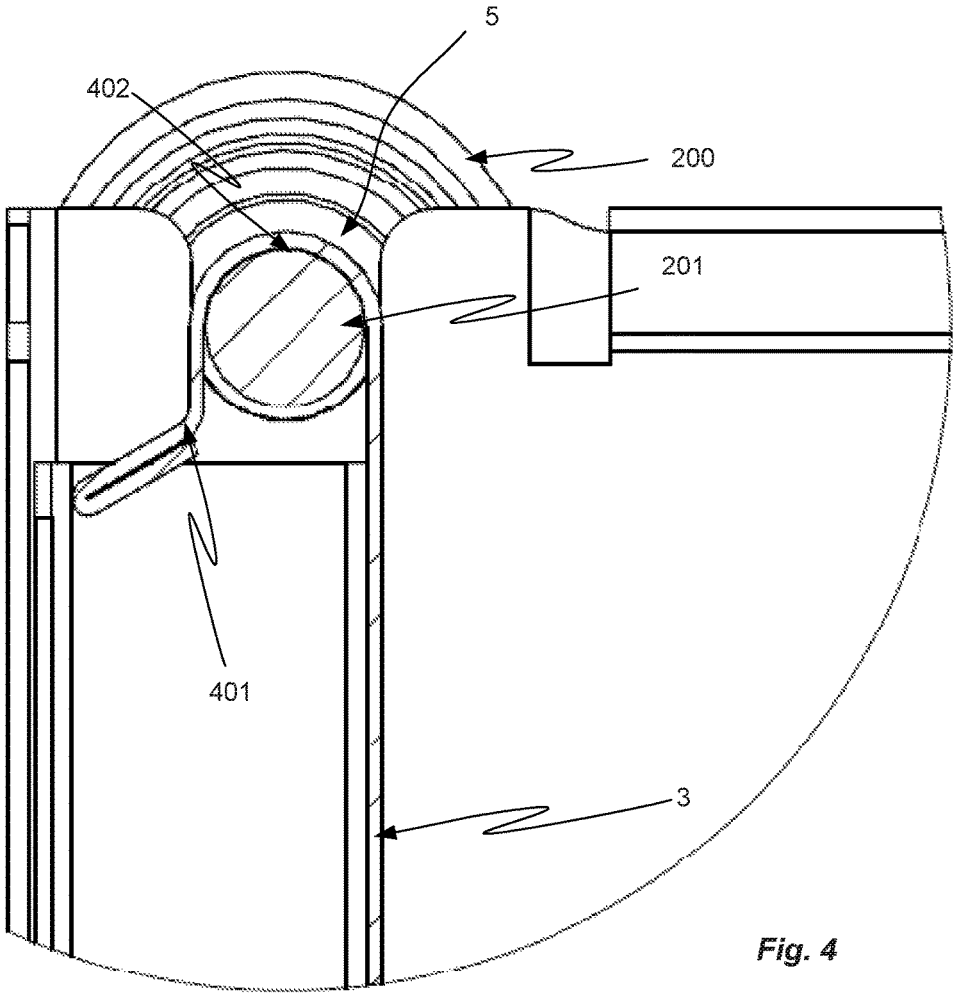
FIG. 4 is a cross-sectional view of a rear panel, forming a first panel, comprising folded edges.

As shown in FIG. 4 the top edge 401 of the first panel 3 can be folded such that the axle 201 is held in place and is hidden from sight if looking at the first panel 3 from above. The folded top edge 401 of the panel 3 forms a receptacle 402 for the axle 201. The receptacle 402 also holds the axle 201 in place.

If the roller wheel assembly 2 is attached to the first panel 3 forming the rear panel of a drawer 1 the second panel 4 forms the side panel of a drawer 1. The opening 5 of the second panel 4 receives the roller wheel assembly 2 attached to the first panel 3.

Figure 5A:
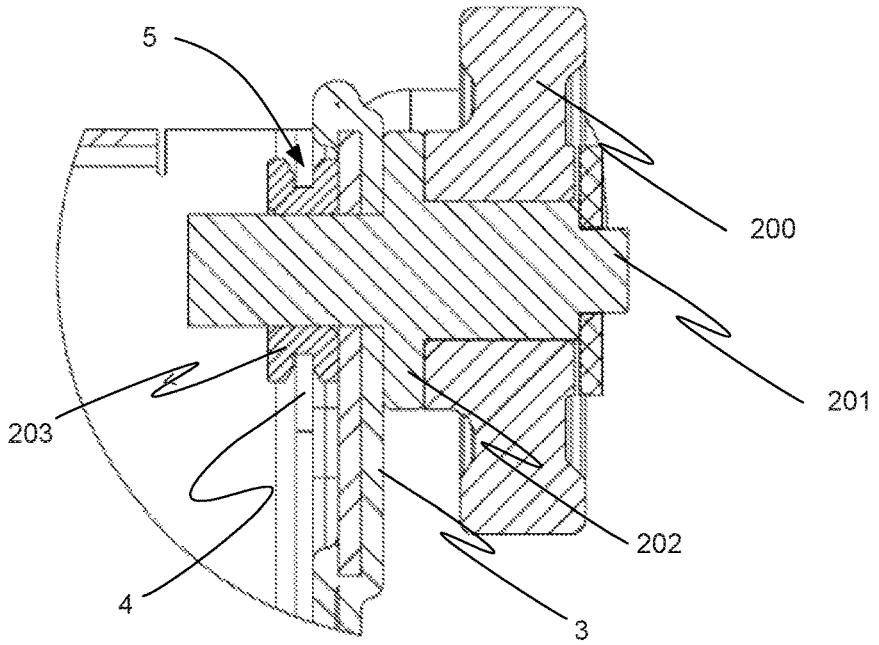
FIG. 5*a* is a cross-sectional view of a roller wheel assembly attached to a first panel and a connected to a second panel.
Figure 5B:
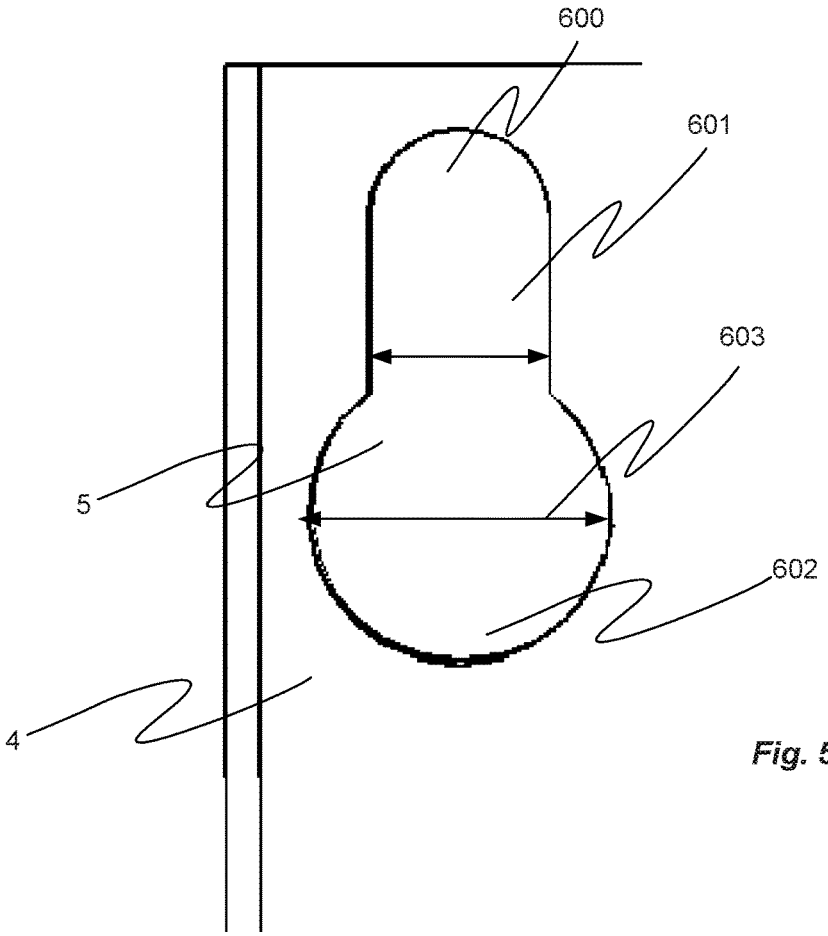
FIG. 5*b* is a front view of a second panel comprising a second embodiment of the slot of the second panel.

As shown in FIG. 5*a* and FIG. 5*b* the opening 5 in the second panel 4 can have the form an inverted keyhole shaped aperture 600. The embodiment of FIGS. 5*a* and 5*b* is applied to an arrangement in which the first panel 3 forms a drawer side, and the second panel 4 is a rear panel. However, the principles described hereinbelow with reference to FIGS. 5*a* and 5*b* may also be applied in a similar manner to an embodiment in which the first panel 3 is a rear panel and the second panel 4 forms a drawer side.

Referring first to FIG. 5*b*, the inverted keyhole shaped aperture 600 comprises an upper inverted U-shaped opening 601 connected to a lower circular bore 602. The bore 602 has a diameter 603 greater than the width of the U-shaped opening 601. The diameter 603 of the lower circular bore 602 is greater than the diameter of the roller wheel assembly 2, such that the roller wheel assembly 2 can fit through the lower circular bore 602. The width of the upper inverted U-shaped opening 601 is approximately equal to the diameter of the circumferential channel 211 of the double flanged washer 203. Thereby, the roller wheel assembly 2 may be inserted into the circular bore 602, and then the roller wheel assembly 2 is moved upwardly such that the double flanged washer 203 comes into co-operation with the inverted U-shaped opening 601, with the circumferential flange 211 being embraced by portions of the inverted U-shaped opening 601, wherein the co-operation between the inverted U-shaped opening 601 and the washer 203 locks the second panel 4 to the roller wheel assembly 2, and, since the roller wheel assembly 2 is attached to the first panel 3, the second panel 4 is thereby locked to the first panel 3. Hence, the inverted keyhole shaped aperture 600 allows the second panel 4 to be held in place by the roller wheel assembly 2.

In other words, the second panel 4 can be slid over the wheel assembly 2 and then moved vertically downwards, such that the walls of the second panel 4 are located within the internal faces 215, 216 of the channel 211 of the double flanged washer 203. The second panel 4 is thus held in place by the double flanged washer 203 and the wheel assembly 2.

As shown in FIG. 5*a* the first panel 3, comprising the roller wheel assembly 2, can form the drawer side. If the first panel 3 forms the drawer side it may be preferable that wheel assembly 2 is attached via the wheel hub 202 to the first panel 3. In an embodiment the first panel 3 forms the drawer side and the second panel 4 forms the rear panel of the drawer. To avoid the problems of points of failure described in the background a proportion of the force on the wheel assembly 2 is transferred to the second panel 4. The force can be transferred by sliding the wheel assembly 2 through the inverted keyhole shaped aperture 600 in the second panel 4 and then locating the panels such that the second panel 4 is held by the double flanged washer 203.

Figure 6:
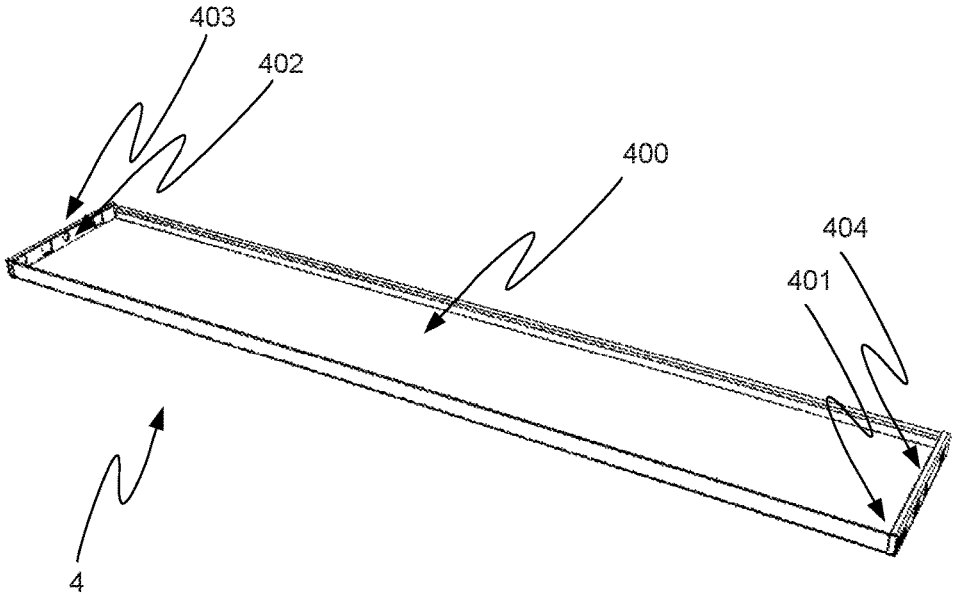
FIG. 6 is an isometric view of a second panel comprising folded edges.

As shown in FIG. 6, the edge of the second panel 4 can be folded at two points along the length of the panel such that the panel comprises a first corner 401 and a second corner 402. The edges 403,404 of the panel 4 can extend from the corners 401, 402 such that the edges 403, 404 of the panel 4 are parallel to one another and perpendicular to the central section 400 of the panel.

As can be seen in FIG. 1 a drawer can comprise at least two side panels at each of which is placed a wheel assembly 2.

The solution described herein is especially suitable for thin walled drawers comprising panels formed of sheet metal. By "thin walled drawer" is meant a drawer in which the first and the second panels 3, 4 are made from sheet metal having a material thickness of 0.5-1 mm.

A process of assembling a drawer with a wheel assembly 2 according to the present invention is as follows: taking a first panel 3 comprising a wheel assembly 2. Thereafter, a second panel 4 comprising an opening 5 is aligned, such that the opening 5 is located at the wheel assembly 2. Then, the wheel assembly 2 is slid in to the opening 5 on the second panel 4. Finally, the second panel 4 is secured to the first panel 3, such that the wheel assembly 2 is received within the opening 5.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A moveable furniture piece comprising:

at least one first panel and at least one second panel arranged perpendicular to one another, said first and second panels being separate parts and being connected to each other, said first panel being provided with a pre-mounted roller wheel assembly comprising a wheel; wherein the roller wheel assembly is positioned adjacent to a side of the moveable furniture piece such that the wheel traverses parallel with the side; and wherein the second panel is provided with an opening dimensioned to receive the roller wheel assembly comprising the wheel.

2. The moveable furniture piece according to claim 1, wherein the first panel forms the rear panel of a moveable furniture piece.

3. The moveable furniture piece according to claim 2, wherein the roller wheel assembly comprises an axle which extends parallel to and along the rear panel and perpendicular to the side of the moveable furniture piece; and wherein the roller wheel assembly is attached to the rear panel via the axle.

4. The moveable furniture piece according to claim 2, wherein the rear panel is provided with at least two wheel assemblies arranged in opposite lateral ends of the rear panel.

5. The moveable furniture piece according to claim 2, wherein a web portion of the rear panel forms a receptacle for an axle connected to the wheel of the roller wheel assembly.

6. The moveable furniture piece according to claim 5, wherein said web portion is a top edge of the rear panel.

7. The moveable furniture piece according to claim 1, wherein the second panel forms the side of the moveable furniture piece.

8. The moveable furniture piece according to claim 1, wherein the roller wheel assembly comprises an axle and a wheel hub wherein the roller wheel assembly is attached via the wheel hub to the first panel.

9. The moveable furniture piece according to claim 8, wherein the axle and the wheel hub are monolithic.

10. The moveable furniture piece according to claim 1, wherein roller wheel assembly is adapted for supporting a connection of the first panel to the second panel.

11. The moveable furniture piece according to claim 10, wherein the wheel assembly comprises a double flanged washer arranged on the axle and co-operating with the second panel.

12. The moveable furniture piece according to claim 1, wherein the second panel comprises an opening having the form of an inverted keyhole aperture co-operating with the roller wheel assembly to connect the first panel to the second panel.

13. The moveable furniture piece according to claim 1, wherein the moveable furniture piece is a drawer.

14. The moveable furniture piece according to claim 1, wherein the first panel is made from sheet metal.

15. The moveable furniture piece according to claim 14, wherein the second panel is made from sheet metal.

16. The moveable furniture piece according to claim 1, wherein the moveable furniture piece is a thin walled drawer comprising panels formed of sheet metal.

17. The moveable furniture piece according to claim 16, wherein the sheet metal has a thickness of 0.5-1 mm.

18. The moveable furniture piece according to claim 16, wherein the moveable furniture piece is constructed so that the opening in the second panel receives the roller wheel assembly comprising the wheel as the first panel and the second panel are connected together.

19. A piece of furniture comprising the moveable furniture piece according to claim 1, and a furniture carcass within which the moveable furniture piece is moveable.

* * * * *